US011357322B2

(12) United States Patent
Xiang et al.

(10) Patent No.: US 11,357,322 B2
(45) **Date of Patent: *Jun. 14, 2022**

(54) LIFTING WORKING-PLATFORM USED ON DESKTOP

(71) Applicant: LOCTEK ERGONOMIC TECHNOLOGY CORP., Ningbo (CN)

(72) Inventors: Lehong Xiang, Ningbo (CN); Tao Lin, Ningbo (CN); Tongwang Shao, Ningbo (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/770,577

(22) PCT Filed: Oct. 11, 2019

(86) PCT No.: PCT/CN2019/110577
§ 371 (c)(1),
(2) Date: Jun. 5, 2020

(87) PCT Pub. No.: WO2020/057671
PCT Pub. Date: Mar. 26, 2020

(65) Prior Publication Data

US 2021/0161289 A1 Jun. 3, 2021

(30) Foreign Application Priority Data

Sep. 21, 2018 (CN) ..... 201821555332.6

(51) Int. Cl.
*A47B 21/02* (2006.01)
*A47B 9/16* (2006.01)
*A47B 21/06* (2006.01)

(52) U.S. Cl.
CPC ..... *A47B 21/02* (2013.01); *A47B 9/16* (2013.01); *A47B 21/06* (2013.01);
(Continued)

(58) Field of Classification Search
CPC ..... A47B 21/02; A47B 21/06; A47B 9/16; A47B 2021/006; A47B 2200/0056; A47B 2200/0066; A47B 3/002; A47B 13/02
(Continued)

(56) References Cited

U.S. PATENT DOCUMENTS 1,797,717 A * 3/1931 Coates ..... B25H 1/02 108/155
3,629,960 A * 12/1971 Roush ..... A47B 41/06 434/429
(Continued)

FOREIGN PATENT DOCUMENTS

CN 105124920 A 12/2015
CN 206150821 U 5/2017
(Continued)

OTHER PUBLICATIONS

CN 209971965; Du et al; abstract and figure (Year: 2020).*
(Continued)

*Primary Examiner* — Janet M Wilkens
(74) *Attorney, Agent, or Firm* — W&KIP

(57) ABSTRACT

A lifting working-platform used on a desktop, has an upper platform, and the side surfaces of upper platform are provided with side plates. The lifting working-platform prevents potential injury of hands if accidently inserting inside during the lifting process of the upper platform and greatly facilitates the installation of a power socket, and avoids outside collision to the plug; and the appearance is appealing; articles such as staplers, erasers and pens can be received in the hanging bucket, thereby ensuring convenience in fetching these articles and reducing occupied space of the lifting working-platform and the desktop, such that the lifting working-platform and the desktop become clean and orderly.

10 Claims, 4 Drawing Sheets

(52) U.S. Cl.
CPC . *A47B 2021/066* (2013.01); *A47B 2200/0056* (2013.01); *A47B 2200/0066* (2013.01)

(58) Field of Classification Search
USPC ..... 312/196, 223.3, 223.6; 108/50.01, 50.02, 108/60, 61, 27, 106, 59, 92, 93, 95, 96, 108/145, 90
See application file for complete search history.

(56) References Cited

U.S. PATENT DOCUMENTS

| | | | | | |
|---|---|---|---|---|---|
| 5,001,779 | A * | 3/1991 | Eggert | B62J 9/25 | 455/346 |
| 5,230,552 | A * | 7/1993 | Schipper | A47B 21/06 | 108/26 |
| 5,890,782 | A * | 4/1999 | Alberts | A47B 17/00 | 312/196 |
| 8,061,278 | B2 * | 11/2011 | Skiba | A47B 9/14 | 108/50.01 |
| 8,424,883 | B1 * | 4/2013 | Ramos | B62B 3/02 | 280/35 |
| 10,856,651 | B2 * | 12/2020 | Huang | A47B 9/02 | |
| 10,973,321 | B2 * | 4/2021 | Allen | A47B 87/002 | |
| 2003/0091784 | A1 * | 5/2003 | Nykamp | A47B 96/206 | 428/99 |
| 2008/0224586 | A1 * | 9/2008 | Yamada | A47B 95/04 | 312/348.4 |
| 2011/0155795 | A1 * | 6/2011 | James | A61G 7/0503 | 229/120.02 |
| 2016/0348358 | A1 * | 12/2016 | Udagawa | E04B 2/7422 | |
| 2017/0000254 | A1 * | 1/2017 | Matlin | A47B 9/02 | |
| 2017/0164731 | A1 * | 6/2017 | Kemnitzer | A47B 83/045 | |
| 2017/0354245 | A1 * | 12/2017 | Martin | A47B 21/02 | |
| 2018/0177289 | A1 | 6/2018 | Chen | | |
| 2020/0150607 | A1 * | 5/2020 | Matlin | A47B 9/10 | |

FOREIGN PATENT DOCUMENTS

| | | | |
|---|---|---|---|
| CN | 206553140 | U | 10/2017 |
| CN | 206565533 | U | 10/2017 |
| CN | 108354323 | A | 1/2018 |
| CN | 206880389 | U | 1/2018 |
| CN | 206994872 | U | 2/2018 |
| CN | 211510925 | * | 9/2020 |
| GB | 2537667 | * | 10/2016 |
| KR | 20120066221 | * | 6/2012 |
| TW | 555167 | U | 2/2018 |

OTHER PUBLICATIONS

KR2008103285; Jung; abstract and figure (Year: 2008).*
International Search Report of PCT/CN2019/110577, dated Dec. 30, 2019.

* cited by examiner

LIFTING WORKING-PLATFORM USED ON DESKTOP

CROSS-REFERENCE

This application is a 371 of international patent application PCT/CN2019/110577 with filing date Oct. 11, 2019, designating to United States, and further claims priority to Chinese Patent Application Number 201821555332.6, filed Sep. 21, 2018. The content of the aforementioned applications, including any intervening amendments thereto, are incorporated herein by reference.

TECHNICAL FIELD

The present invention relates to the technical field of office learning equipment, in particular to a lifting working-platform used on a desktop.

BACKGROUND

The lifting office tables or desks in the prior art have been well established, which arise largely from a new requirement for work and study of people in recent years, in other words, pursuit of personality. Specifically speaking, from the perspective of health, they desire to have such an office table or desk that is liftable at will so as to meet requirements on different heights when in different sitting or standing postures. To meet this new requirement, a lifting table is the best choice in the primary purchase, however, there is a problem that a majority of the office tables or desks being used currently are stationary. Until recently, a lifting working-platform used on a desktop, also known as a lifting platform used on a desktop emerges, which not only can meet different requirements of people on heights but also can make full use of the fixed office tables or desks in hand, thereby substantially solving the aforesaid problem. For example, the preceding Chinese patent applications of the applicant with the publication numbers of CN 108354323A and CN 206553140U have respectively disclosed a lifting platform used on a desktop that comprises an upper platform or called a top frame, a lower platform or called a base, and an X-shaped lifting arm or called a scissor-type lifting arm connecting the upper and lower platforms, and the top end of the X-shaped lifting arm is slidably fitted on the bottom of the upper platform and the bottom end of the X-shaped lifting arm is slidably fitted on the top of the base so as to make the upper platform ascend when a gas spring spreads, while a man power or an electric pressure is applied to offset the elasticity of the gas spring to make it retract such that the top frame descends. However, regardless of manual lifting or electrical lifting, there remain the following deficiencies in the existing lifting platform used on a desktop when in actual use:

1. there is no protection structure around the upper platform. Therefore, in the lifting process of the upper platform, fingers have high possibility of being collided even injured if inserted into the gap of the upper platform, i.e., the top frame carelessly; no proper positions are reserved for any plugs and sockets when a power module in the lifting working-platform is electrified in actual use, so that mating of the plug and socket is inconvenient; unpleasant appearance of the lifting platform brings down its whole quality and sale price.

2. When an existing power plug is mated with a socket on a board, an angle of 90° formed between the power plug and the board gives rise to the remarkable defects that exterior space is occupied, the plug is easily collided to cause poor electric contact that may influence normal work or even damage the plug. 3. When the lifting working-platform used on a desktop in the prior art operates, articles such as a mobile phone, a stapler, a shaver, an eraser, pens and the like are scattered on it, occupying limited space of the lifting platform and the desktop and producing a disorderly look.

SUMMARY

The technical problem to be solved by the present invention is to provide a lifting working-platform used on a desktop, preventing potential injury of hands if accidently inserting inside during the lifting process of the upper platform and greatly facilitating the installation of a power socket. The technical solution of the present invention provides a lifting working-platform used on a desktop, comprising an upper platform where a display is placed; a base is placed on an existing desktop; a lifting component connected between the upper platform and the base for adjusting the height of the upper platform; a side plate arranged around the upper platform, and at least one portion of the side plate shields the outside of the upper platform.

By adopting the above structure, the lifting working-platform used on a desktop of the present invention has the following advantages: a side plate, serving as a protection structure, is mounted on the side from which a hand easily stretches into the upper platform, i.e., the top frame, effectively preventing hands from inserting the top frame by mistake in the lifting process of the top frame and avoiding hand injury. Besides, due to the side plate on the upper platform, a proper position is provided for a plug or socket when a power module in the lifting working-platform is electrified. Further, mating becomes convenient for the plug and the socket are mounted on the side plate.

In a preferred embodiment, the side plate is mounted on at least one side surface of the left side surface, the rear side surface away from a computer operator and the right side surface of the upper platform. The above structure makes the protection function of the side plate more effective and installation position of the plug or socket more proper.

In a preferred embodiment, the side plate is mounted on each of the left side surface, the rear side surface away from a computer operator and the right-side surface of the upper platform. The above structure makes the protection function better, the appearance of the lifting working-platform more appealing and the whole quality and sale price of the lifting working-platform used on a desktop increased.

In a preferred embodiment, the side plate between the left side surface and the rear side surface is in smooth transition, so is the side plate between the rear side surface and the right-side surface. The above structure makes the protection function better, the appearance of the lifting working-platform is further improved, and the whole quality and sale price of the lifting working-platform used on a desktop further increased.

In a preferred embodiment, the outer surface of the side plate has a flexible protection layer. By adopting the above structure, the technical effect of preventing hands from being collided to avoid injury becomes better, appearance is greatly improved and may be further improved if the layer is patterned, and the whole quality and sale price are further increased.

In a preferred embodiment, the flexible protection layer is made of a fabric covering the outer surface of the side plate. The above structure after used produces a better protection effect and an elegant appearance.

In a preferred embodiment, a gap reserved between the side plate and the edge of the upper platform forms a hanging groove for suspension of articles. By adopting the above structure, a structure support is provided for hooking of a hanging bucket, and material is saved due to simplified structure.

In a preferred embodiment, it also comprises a hanging bucket for containing articles, hooked at the top end of the side plate through the hanging groove. By adopting the above structure, articles such as mobile phones, staplers, shavers, erasers and pens can be received in the hanging bucket, thereby ensuring convenience in fetching these articles and reducing occupied space of the lifting working-platform and the desktop, such that the lifting working-platform and the desktop become clean and orderly.

In a preferred embodiment, the side plate of the rear side is provided with an opening for containing a power plug and/or a socket. By adopting the above structure, when the power plug and/or socket is mated, it is inwardly contained inside the side plate, thereby occupying no exterior space, preventing the plug from being collided by other objects, and ensuring stable good electric contact of the power plug and socket, thus further ensuring stable operation of the lifting working-platform and no damage of the plug.

In a preferred embodiment, a mounting box with a cover plate is mounted in the opening inwardly, the interface of the power module of the lifting working-platform is disposed in the mounting box, and a notch for entrance of a power lead is reserved on the cover plate. By adopting the above structure, the power plug or socket occupies less interior space, and is well protected, the lead is convenient to go in or out, and a display looks better.

In a preferred embodiment, the upper platform is provided with a first desk plate away from a user side and a second desk plate close to the user side, and the first and second desk plates are connected through a connecting plate. By adopting the above structure, a protection role is given into a full play, practicability and convenience are brought, and the whole quality and sale price of the lifting working-platform used on a desktop are increased.

Figure 1:
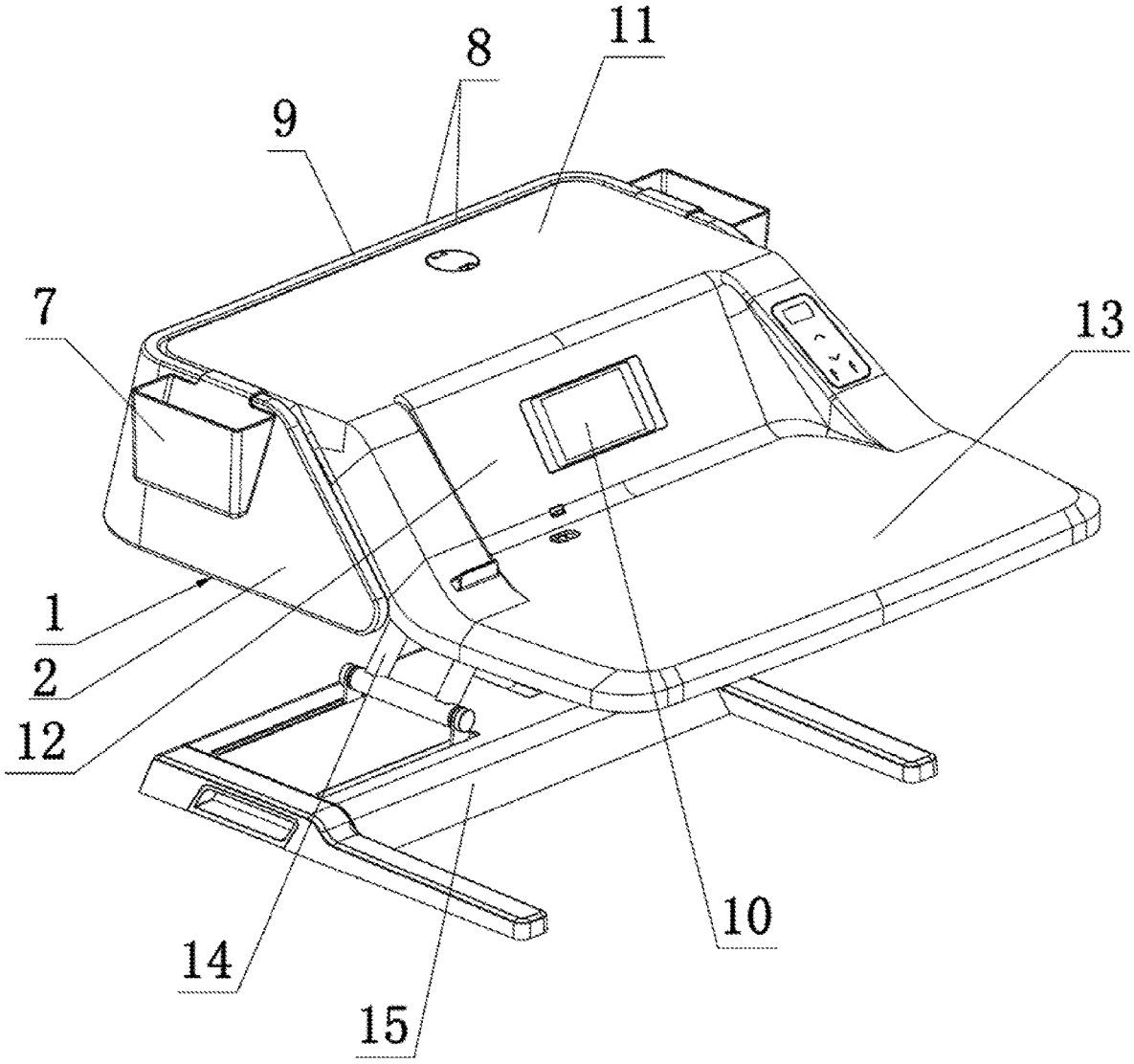
FIG. 1 schematically shows a front side-view of a structure of a lifting working-platform used on a desktop of the present invention.

The reference numerals denote: 1 upper platform; 2 side plate; 3 flexible protection layer; 4 cover plate; 5 mounting box; 6 notch; 7 hanging bucket; 8 guide rail; 9 sliding chute; 10 display screen; 11 first desk plate; 12 connecting plate; 13 second desk plate; 14 lifting component; 15 base.

EMBODIMENTS

Preferred embodiment of the present invention would be descried in greater detail hereinafter in combination with the accompanying drawings. It should be noted that, these explanations about the above preferred embodiment merely serve the purpose of a better understanding of the present invention, but are not intended to limit it. Furthermore, the technical features involved in the described preferred embodiment of the present invention can be combined as long as they do not contradict each other.

Figure 2:
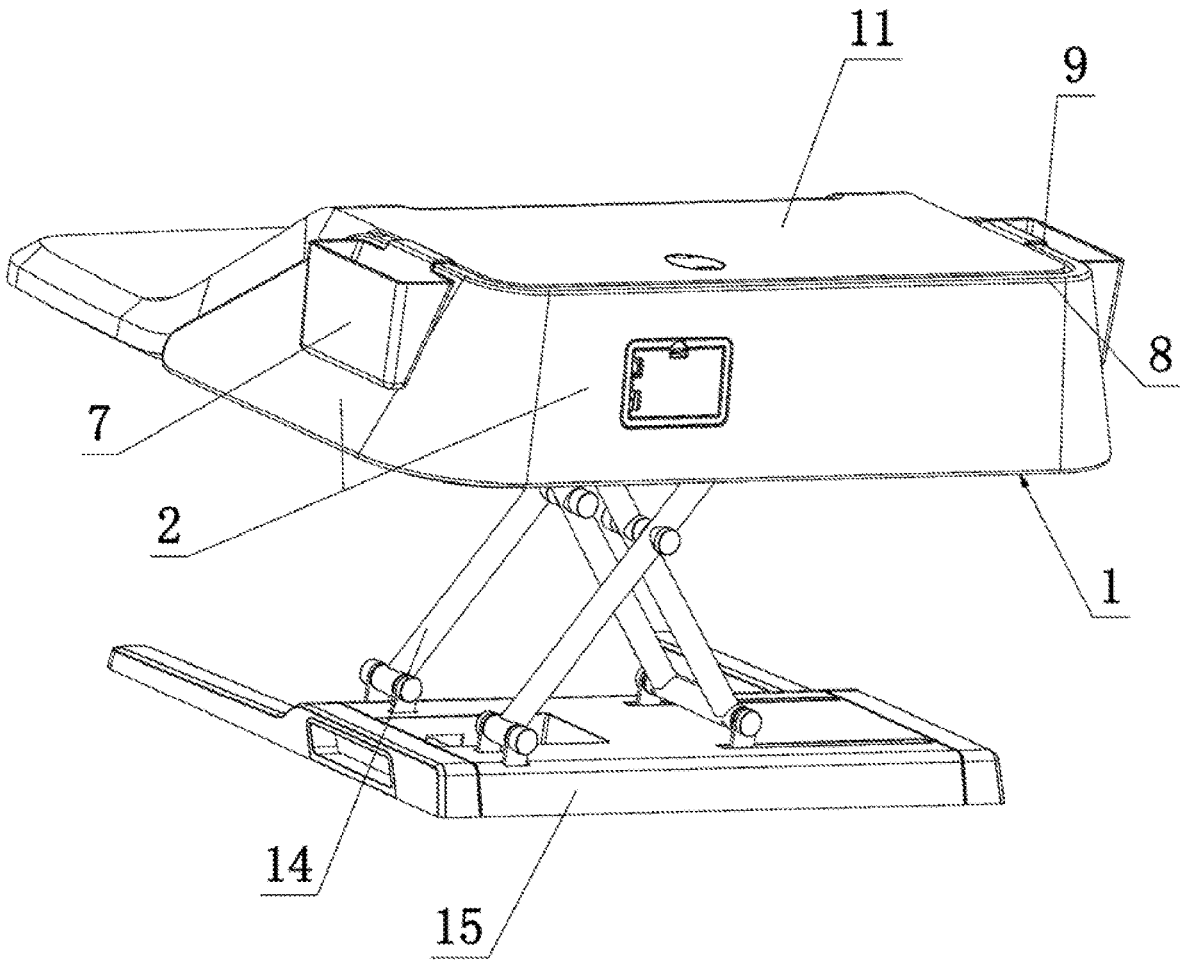
FIG. 2 schematically shows a rear side-view of the structure of the lifting working-platform used on a desktop of the present invention (with the flexible protection layer on the surface not shown).
Figure 3:
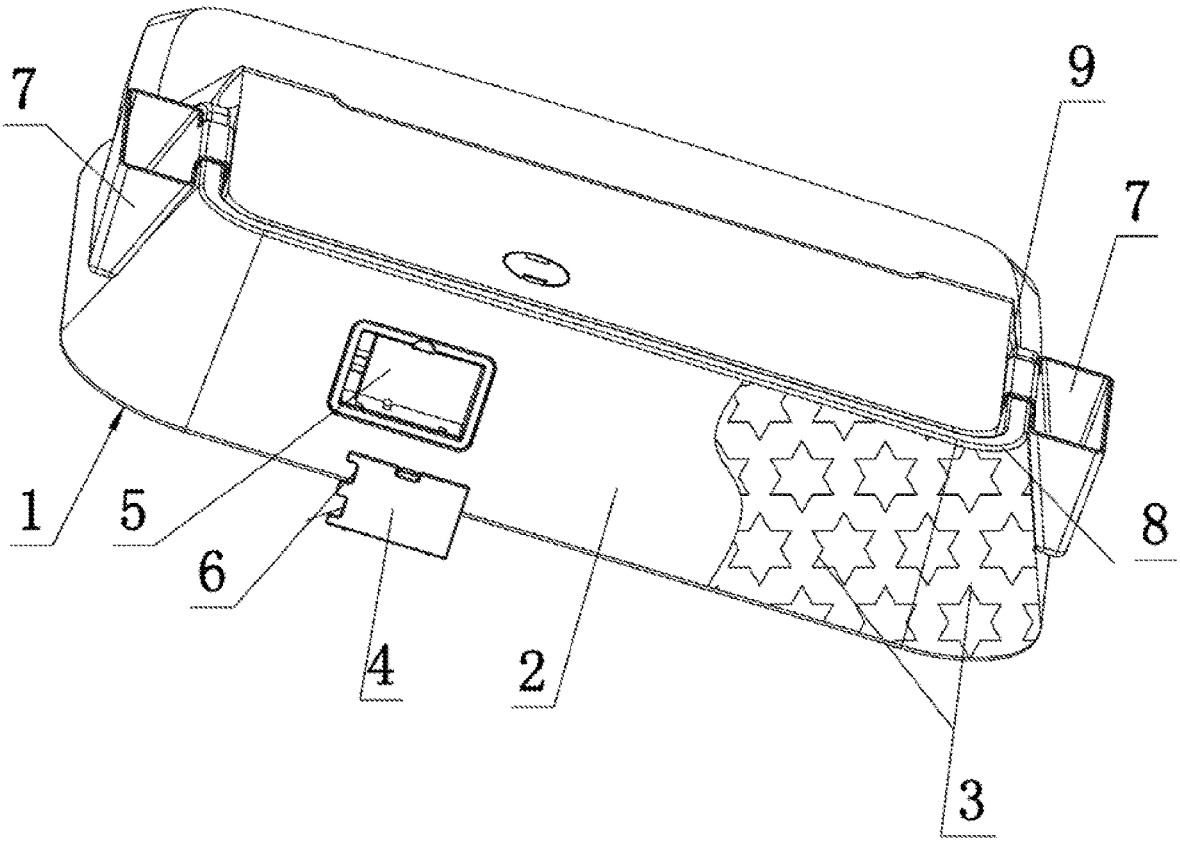
FIG. 3 schematically shows a rear side-view of a structure of a display working station used on a desktop of the present invention (illustrating an exploded view of the flexible protection layer on the surface, a mounting box and a cover plate).

As shown in FIG. 1, FIG. 2 and FIG. 3, the lifting working-platform used on a desktop, also known as a lifting platform used on a desktop, provided in the present invention comprises a manual lifting working-platform and an electric lifting working-platform.

The lifting working-platform used on a desktop of the present invention is improved on the basis of the lifting working-platform used on a desktop in the prior art, e.g., on the basis of the electric lifting platform used on a desktop as disclosed by the same applicant in the preceding Chinese patent application with the publication No.: CN 206553140U, the manual lifting platform used on a desktop as disclosed by the same applicant in the preceding Chinese patent application with the publication No.: CN 108354323A, or the manual lifting platform used on a desktop as disclosed by the same applicant in the preceding Chinese patent application with the publication No.: CN 105124920B.

The lifting working-platform used on a desktop of the present invention comprises an upper platform 1 that is also called a top frame, used for installation of a display, and known by common knowledge, a notebook computer is also allowable. A base 15, also called a lower platform, is installed on an existing desktop. A lifting component 14 connected between the upper platform 1 and the base 15 is used for adjusting the height of the upper platform 1. The upper platform 1 is provided with a first desk plate 11 away from a user side and a second desk plate 13 close to the user side. The first and second desk plates 11, 13 are connected through a connecting plate 12. Apparently, when the first desk plate of the upper platform 1 is equipped with a display of a desktop computer, there may provide a keyboard on the second desk plate 13. Generally, a notebook computer is arranged on the second desk plate 13. Having such a structure of inclining from upper rear side to lower front side, the connecting plate 12 may be provided with a display screen 10.

A side plate 2 is arranged around the upper platform 1, with at least one portion thereof shielding the outside of the upper platform 1. The side plate 2 can be arranged on at least one side surface of the left side surface, the rear side surface away from a computer operator and the right side surface of the upper platform 1. Preferably, it is arranged on each of the left side surface, the rear side surface away from a computer operator and the right side surface of the upper platform 1, that is, preferably, three side surfaces are provided with the side plate 2 respectively, and can be called a left side plate, a rear side plate away from an operator and a right side plate. The side plate between the left side surface and the rear side surface is in smooth transition, for example, by disposing an arc-shaped transition plate. The side plate between the rear side surface and the right side surface is also in smooth transition, for example, also by disposing an arc-shaped transition plate.

The outer surface of the side plate 2 has a flexible protection layer 3. That is, the outer surface of the side plate 2 is covered with a flexible protection layer 3 totally. The flexible protection layer 3 is made of a fabric covering the outer surface of the side plate 2. For example, a lint layer like a blanket layer is glued. Further, other flexible materials such as foam, rubber, polyester fiber are available. Besides, the surface of the flexible protection layer 3 also can be patterned to improve its beautiful degree.

Figure 4:
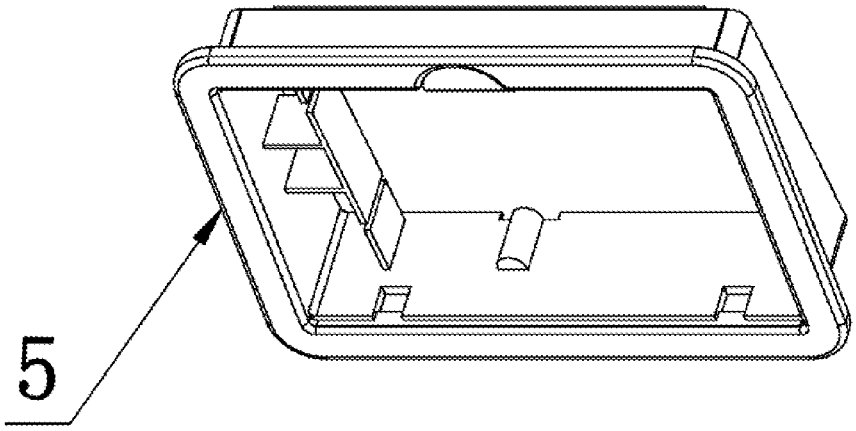
FIG. 4 is a schematic structural diagram of the mounting box of the present invention.

The side plate 2, such as the side plate of the rear side surface, that is, the rear side plate is provided with an opening for containing a power plug and/or a socket. The wording "and/or" should be understood as that preferably, the plug and socket are in plugging fit, optionally, there can only be a plug or a socket, but a lead is led out, and then a respective socket or plug is outer connected. Referring to FIG. 4, a mounting box 5 with a cover plate 4 is mounted in the opening. In case of plugging the plug into the socket, the socket is mounted on one end of the mounting box 5, the plug after plugged in the socket in the mounting box 5 is parallel to the cover plate 4, and a notch 6 for entrance of a power lead is formed on the cover plate 4. None of the plug, socket and lead is shown in the drawings.

The gap reserved between the side plate 2 and the edge of the upper platform 1 (e.g., the first desk plate 11) forms a hanging groove 9. A hanging bucket 7 for containing odd articles is also provided. The hanging bucket 7 is hooked on the top end of the side plate 2 through the hanging groove 9. If the hanging groove 9 is continuous, it can serve as a sliding chute. For example, there may provide a guide rail 8 on the top of the side plate 2 to permit the hanging bucket 7 to slide to a desired site along the peripheral edge. One or two hanging bucket s 7 are possible. The sliding chute is distributed along the left edge, the rear edge away from a computer operator and the right edge of the lifting working-platform. The bend of the sliding chute is in smooth transition, e.g., circular arc transition. Optionally, the guide rail 8 is not provided which means the hanging groove is not a sliding chute any more, i.e., the hanging bucket 7 is merely hooked instead of sliding.

The above is merely the description of the preferred embodiment of the present invention, but is not intended to limit the present invention. It should be understood by one skilled in the art that, the present invention may have various modifications and variations. Further, any modifications, equivalent substitutions, improvements and the like that are within the spirit and the scope of the present invention shall fall into the scope of protection of the present invention.

We claim:

1. A lifting working-platform used on a desktop, comprising:

an upper platform (1), where a display is placed, and wherein the upper platform is capable of being lifted;

a base (15), to be placed on an existing desktop;

a lifting component (14) connected between the upper platform (1) and the base (15) for adjusting the height of the upper platform (1);

wherein a side plate (2) is fixedly arranged around the upper platform (1), and at least one portion of the side plate (2) shields the outside of the upper platform (1) from the inside, extends downward, and is capable of preventing potential injury of hands if accidently inserting inside during the lifting of the upper platform;

wherein a gap reserved between the side plate (2) and the edge of the upper platform (1) forms a hanging groove (9) for suspension of articles.

2. The lifting working-platform used on a desktop of claim 1, wherein the upper platform comprises a left side surface, a rear side surface, and a right side surface, the rear side surface is away from a computer operator, and the side plate (2) is mounted on at least one side surface of the left side surface, the rear side surface and the right side surface.

3. The lifting working-platform used on a desktop of claim 2, wherein the side plate (2) is mounted on the left side surface, the rear side surface away from the computer operator and the right side surface of the upper platform (1).

4. The lifting working-platform used on a desktop of claim 3, wherein the side plate (2) between the left side surface and rear side surface is in smooth transition, and the side plate (2) between the rear side surface and right side surface is also in smooth transition.

5. The lifting working-platform used on a desktop of claim 3, wherein the side plate (2) of the rear side surface is provided with an opening for containing a power plug and/or a socket.

6. The lifting working-platform used on a desktop of claim 5, wherein a mounting box (5) with a cover plate (4) is mounted in the opening inwardly; the lifting working-platform comprises a power module, the interface of the power module is arranged in the mounting box (5), and a notch (6) for inserting a power lead is reserved on the cover plate (4).

7. The lifting working-platform used on a desktop according to claim 1, wherein the side plate (2) comprises an outer surface, and the outer surface of the side plate (2) has a flexible protection layer (3).

8. The lifting working-platform used on a desktop of claim 7, wherein the flexible protection layer (3) is made of a fabric, and the fabric covers the outer surface of the side plate (2).

9. The lifting working-platform used on a desktop of claim 1, wherein it further comprises a hanging bucket (7) for containing articles, and the hanging bucket (7) is hooked at the top end of the side plate (2) through the hanging groove (9).

10. The lifting working-platform used on a desktop of claim 1, wherein the upper platform (1) is provided with a first desk plate (11) away from a user side and a second desk plate (13) close to the user side and the first desk plate (11) and the second desk plate (13) are connected through a connecting plate (12).

* * * * *